United States Patent [19]

Geer et al.

[11] 4,006,951

[45] Feb. 8, 1977

[54] LOCKING MECHANISM FOR A SLIDE DRAWER

[75] Inventors: Larry A. Geer, Upland; Ralph L. Sheffer, Arcadia, both of Calif.

[73] Assignee: Adams Rite Products, Inc., Glendale, Calif.

[22] Filed: June 12, 1975

[21] Appl. No.: 586,291

[52] U.S. Cl. ..... 312/320; 312/333

[51] Int. Cl.[2] ..... A47B 88/16

[58] Field of Search ..... 312/320, 333, 348; 308/3.6, 3.9; 292/240; 3/319, 333, 338, 339, 342

[56] References Cited

UNITED STATES PATENTS

| | | | |
|---|---|---|---|
| 513,439 | 1/1894 | Parmele | 312/333 |
| 2,856,450 | 10/1958 | Padgett et al. | 312/320 R |
| 2,869,960 | 1/1959 | Medow | 312/333 |
| 2,944,864 | 7/1960 | Krivulka | 312/320 |
| 3,129,981 | 4/1964 | Meyer | 312/348 X |
| 3,133,768 | 5/1964 | Klakovich | 308/3.6 |
| 3,278,250 | 10/1966 | Vogt | 312/348 X |
| 3,367,732 | 2/1968 | Beye | 312/320 |
| 3,447,850 | 6/1969 | Samson | 312/320 X |
| 3,521,939 | 7/1970 | Fall et al. | 312/333 X |
| 3,700,301 | 10/1972 | Boeck | 312/333 |

FOREIGN PATENTS OR APPLICATIONS

| | | | |
|---|---|---|---|
| 1,166,495 | 11/1958 | France | 312/333 |
| 77,014 | 8/1894 | Germany | 313/348 |

*Primary Examiner*—Casmir A. Nunberg
*Attorney, Agent, or Firm*—Whann & McManigal

[57] ABSTRACT

Manually controlled locking mechanism for a cabinet drawer of the slide mounted type, wherein a plurality of actuators are selectively manually operable to provide a plurality of different locking functions with respect to the slide drawer.

One of said actuators controls locking elements which are arranged to function in the final closing movement of the drawer to forceably move the drawer to a fully closed and locked position, and in the initial opening movement of the closed drawer, after being unlocked, to forceably move the drawer outwardly from the fully closed position.

Another of the actuators controls locking elements operable with respect to the slide mounting of the drawer in open and closed positions thereof to frictionally retain and hold the drawer against opening and closing movements, and against vibrational movements in horizontal and vertical directions within the cabinet.

17 Claims, 9 Drawing Figures

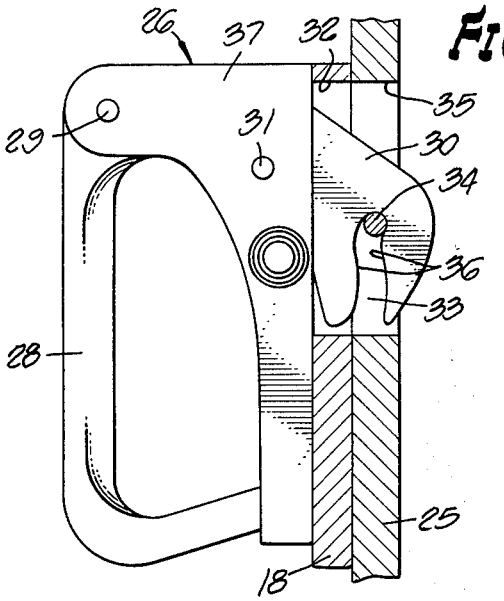
FIG. 3.
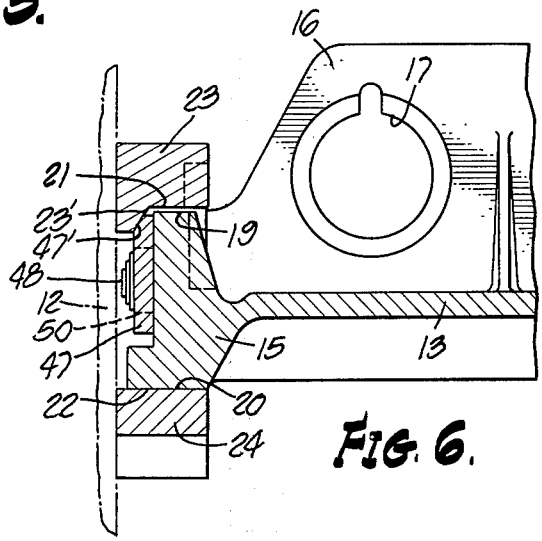
FIG. 6.
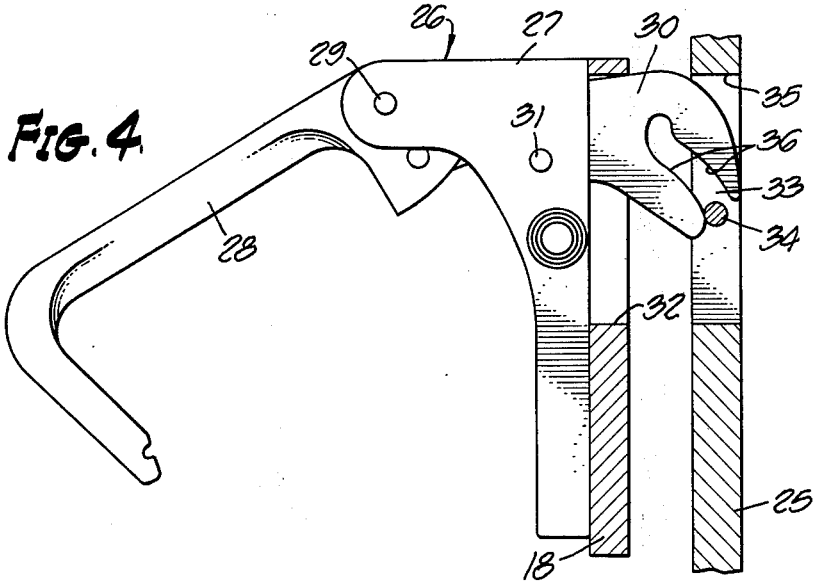
FIG. 4.
FIG. 5.
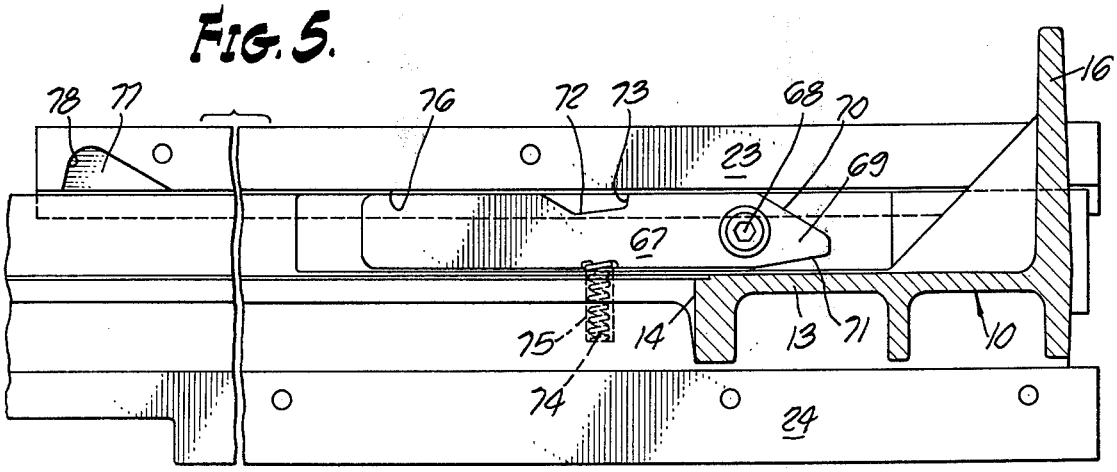

19
21
52
23
77
78
47'
51
50
55
59
60
58
57
54
59
53
40
37
41
42
64
56
63
61
62
39
41
44
66
65
46
47
49
48
50
15
22
45
18
10
38
43
24

40
37
38
43
41
64
61
62
63
56
42
39
41
57
54
60
55
59
58
59
53
21
23
77
44
19
52
50
47'
51
47
78
66
65
15
46
10
48
49
50
18
24
22
45

16
11
78
77
79
80
76
73
72
23
67
68
70
74
75
14
71
13
10
15
24

LOCKING MECHANISM FOR A SLIDE DRAWER

BACKGROUND OF THE INVENTION

The present invention relates generally to cabinet mounted drawers of the slide mounted type.

It has heretofore been a common practice in cabinet mounted slide drawer arrangements to provide the drawer on its opposite sides with side rails which are respectively slidably guided in their sliding movement by upper and lower guide rails fixedly supported on the cabinet.

Such conventionally known drawer arrangements find quiet general use in industrial installations for the mounting of electronic and other electrical components in order to provide quick access to the drawer mounted equipment for the purpose of checking, maintenance, repair, replacement, and other reasons. In such installations, it is customary to provide at the back of the drawer, a plurality of electric plug connectors which will be engaged during the final closing movement of the drawer, and disengaged during the initial opening movement of the drawer. It will be appreciated that this engagement and disengagement of the plug connectors requires the application of increased forces over and above that normally required to slidably move the drawer. Additional means are therefore desirably necessary to mechanically produce these increased forces in a practical manner, and which will also function to effectively and releasably lock the drawer in its fully closed position.

For the foregoing purpose, the present invention provides a first actuator means in the form of a drawer handle which is operable in the usual manner for opening and closing the drawer. This handle is swingably mounted and connected with a swingably mounted hook which is movable between locking and non-locking positions in response to the handle movements. The hook has an end opening slot adapted in the non-locking position of the hook to receive a cabinet mounted keeper thereinto as the drawer approaches a fully closed position, and in which position the plug connectors are beginning their engagement. The actuator handle may now be swung in a direction to swing the hook towards its locking position to force the keeper further into the slot to a position in which a camming surface is effective to apply increased forces to the drawer for completing its movement to a fully closed position in which the plug connectors will be fully connected. The camming surface of the hook is also operative to apply increased forces during the initial opening movement of the drawer from its fully closed position during which time the plug connectors will be disconnected.

A further important vital problem arises when it is attempted to use these known cabinet drawer mounting arrangements for the drawer mounting of electronic and other sensitive equipment in cabinet locations, such as on shipboard, where they may be subjected to environmental vibrations and shock forces which can be generated and magnified to undesirable proportions by movements of the slidable drawers within the clearance limits of their cabinet slide mounting structures.

In the present invention, the foregoing problem has been solved by the provision of a second actuator means in the form of a unique slide locking mechanism. For such purpose, similar locking mechanisms are carried respectively on the opposite sides of the drawer and include in each case a manually operable elongated locking bar which is mounted on a drawer slide rail for translatory movement throughout its length between a non-locking lowered position and a locking raised position in which it engages one of the guide rails with a resiliently applied wedging action that is effective in both a horizontal direction and a vertical direction to positively remove loose clearances in the slide mounting structure of the sliding drawer. Thus, shock and vibrational loads applied to the cabinet will not be amplified by reason of loose sliding clearances in the drawer mounting, or transmitted into the sensitive electronic or other equipment mounted in the drawer.

SUMMARY OF THE INVENTION

The present invention relates generally to cabinet mounted sliding drawers, and is more specifically directed to improved means which are manually selectively operable to produce a multiplicity of drawer controlling functions.

It is one object of the herein described invention to provide unique manually controlled locking mechanism having a plurality of actuators that are selectively operable to provide a plurality of locking functions.

A further object is concerned with the provision in a sliding drawer structure of manually operable drawer actuating means for applying increased drawer closing and opening forces as the drawer approaches a fully closed position, and as the drawer initially leaves a fully closed position in an opening direction.

A still further object is to provide actuator means according to the foregoing object, wherein a manually swingable hook member on the drawer is arranged to operably coact with a fixed keeper on a cabinet containing the drawer to produce increased drawer moving forces by a camming action.

Another object is to provide in a sliding drawer structure, improved actuator means which are carried by the drawer, and in which a manually swingable handle is operable to move associated locking elements into locking and non-locking positions, and wherein in the locking position the drawer will be resiliently anchored and held against relative movements within the clearance limits of its slide mounting.

Still another object relates to the provision of a novel latching mechanism for a cabinet mounted sliding drawer which will be automatically operative at the fully opened position of the drawer to prevent complete removal of the drawer from the cabinet, but which is readily accessible for manual release to enable removal of the drawer, when necessary.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 3 is a side elevational view, partly in section, taken substantially on line 3—3 of FIG. 2, and showing the structure of first actuator means for moving the drawer to fully closed position and initially moving the drawer from a fully closed position in an opening direction with increased force, the drawer being shown in fully closed position;

FIG. 4 is a view similar to that of FIG. 3, showing the relationship of the parts when the drawer is in a slightly opened position;

FIG. 5 is an enlarged fragmentary sectional view taken substantially on line 5—5 of FIG. 2, and showing details of the releasable latching means for preventing inadvertent complete removal of the drawer from the cabinet;

FIG. 6 is an enlarged fragmentary sectional view taken substantially on line 6—6 of FIG. 2, and showing details of the slide rail mounting for the drawer;

DESCRIPTION OF THE PREFERRED EMBODIMENT

Figure 1:
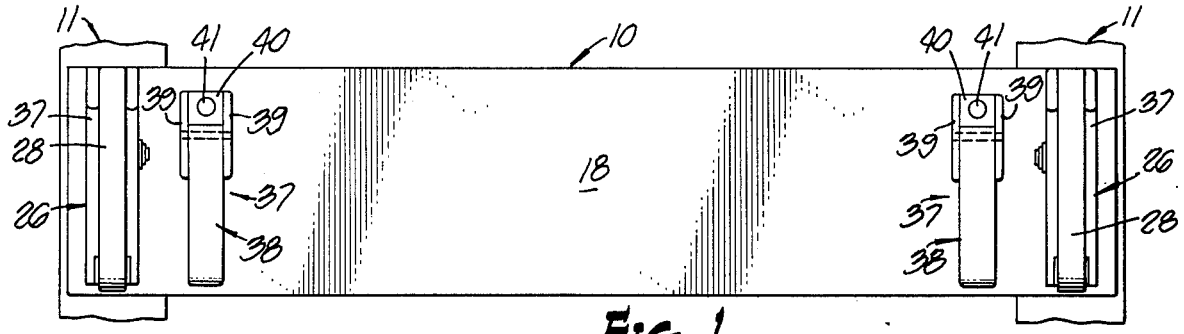
FIG. 1 is a front elevational view of a cabinet mounted sliding drawer embodying the features of the herein disclosed invention.

Referring now specifically to the drawings, for illustrative purposes, a locking mechanism for a cabinet mounted slide drawer which embodies the features of the present invention is disclosed in FIG. 1 wherein a sliding drawer, as generally indicated by the numeral 10, is operatively mounted for sliding movements in an associated upstanding cabinet structure as generally indicated by the numeral 11. The drawer structure and the cabinet structure may vary with respect to details. For illustration, the cabinet in the present disclosure is shown as having cellular side walls with inner side walls 12 at the opposite sides of the drawer receiving opening of the cabinet. In the present instance, the drawer structure is illustrated as comprising a unitary casting which includes a drawer bottom 13 having an open area 14, longitudinally extending side walls 15, a rear wall structure 16 which may contain a series of openings 17 for the mounting of electric plug-type connectors (not shown), and an upstanding front drawer panel 18. It is to be understood, however, that while the panel 18 is shown as being an integral part of the drawer structure, this panel may be fabricated as a separate element and secured to the drawer structure by conventional means.

As will best be seen in FIG. 6, the drawer side walls 15 are utilized as drawer supporting side rails, and for this purpose the upper and lower edges are machined to provide parallel surfaces 19 and 20 of relatively large areas for sliding engagement with operatively associated machined surfaces 21 and 22 respectively of relatively large areas on associated upper and lower guide rails fixedly secured to the inner surface of the adjacent cabinet side wall 12 by conventional means. The side walls 15 and associated large contact areas provide for desirable heat transfer from the drawer to the cabinet structure.

Figure 2:
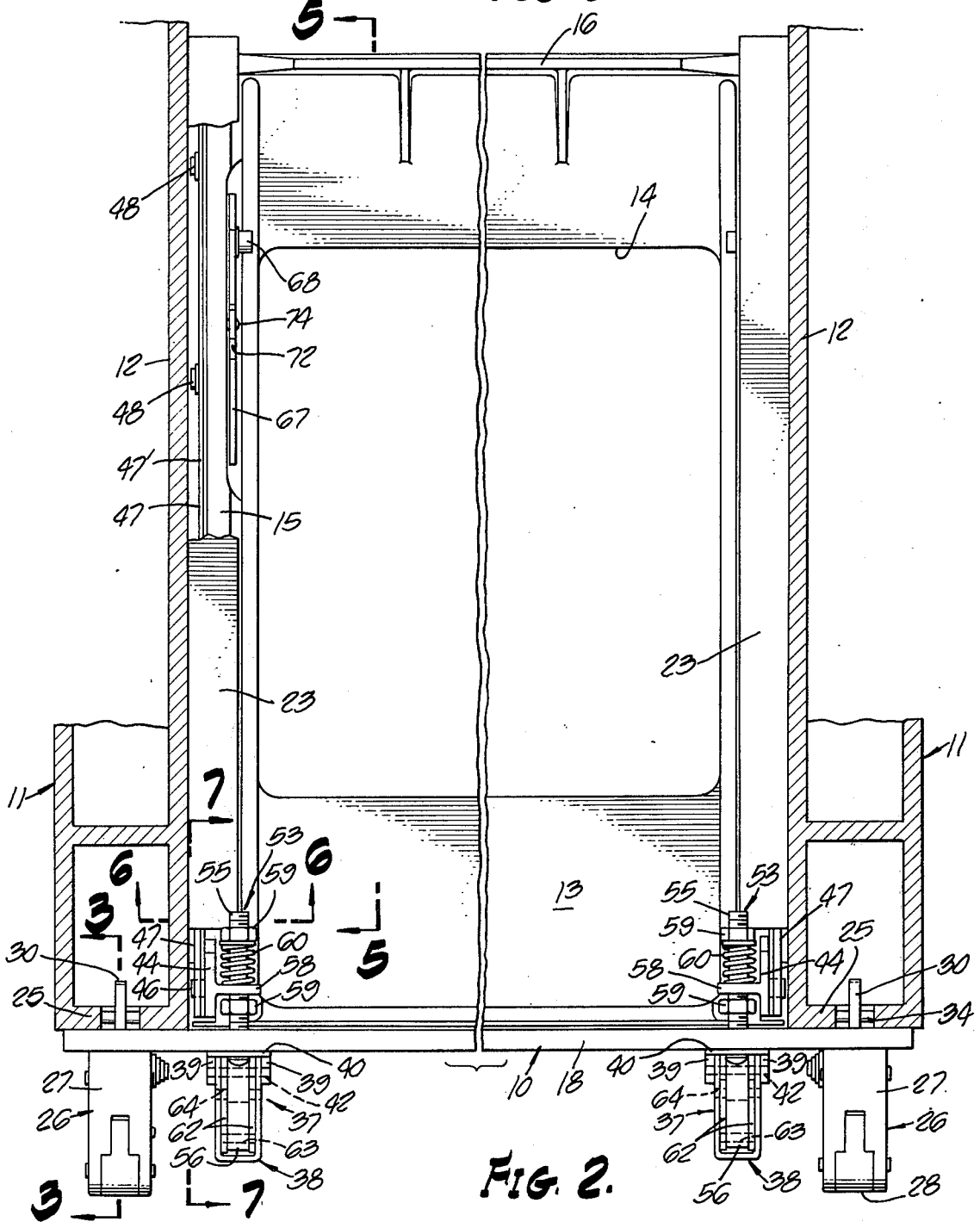
FIG. 2 is an enlarged fragmentary plan view of the same, certain portions being shown in section and other portions being cut away to disclose the operational relationship of certain of the elements.

As best shown in FIG. 2, the front panel 18 of the drawer has end portions which project beyond the inner side walls of the cabinet, and are adapted to bear against forward wall portions 25 of the cabinet side wall structure, when the drawer is in fully closed position.

FIRST MANUAL ACTUATOR MEANS

Cabinet mounted sliding drawers are in many installations utilized for the mounting of electronic and other electrical equipment which necessitate the utilization of electric plug connectors mounted on the rear wall of the drawer for engagement with mating receptacles mounted on the rear wall of the cabinet. In such installations, it will be appreciated that during the engagement and disengagement of these plug connectors, it will be necessary to apply increased drawer moving forces over and above the force that is required for the normal drawer movement.

For applying these increased forces during the engaging and disengaging operations of the plug connectors, it is a feature of the present invention to mount a pair of first actuators, as generally indicated by the numeral 26, respectively at the projecting end portions of the front panel 18.

As shown in FIGS. 3 and 4, each actuator 26 comprises a mounting bracket 27 which is secured in an upright position against the forward surface of the front panel 18 by conventional means, not shown. This mounting bracket carries an L-shaped handle member 28 which is pivoted at its uppermost end on a pivot pin 29 for movement between a position in which its lowermost end engages the mounting bracket, as shown in FIG. 3, and an outer inclined position with respect to the bracket, as shown in FIG. 4. The uppermost end of the handle 28 is connected by an operating linkage, not shown, with a swingably mounted hook 30 supported on the bracket by a pivot pin 31. As shown, the hook 30 projects rearwardly of the mounting bracket 27 and extends through a suitable opening 32 of the panel 18. The hook is formed with an end opening slot 32 which is adapted, when the hook is moved by means of the handle 28 to the position shown in FIG. 4, to receive through its open end a transversely extending keeper 34, this keeper having a circular cross-section and extending transversely of an opening 35 formed in the adjacent forward wall portion 25 of the cabinet.

With the panel 18 slightly spaced from the wall portion 25, and the keeper 34 disposed in the open end of the slot 33, the handle 28 can then be moved to the position shown in FIG. 3 in which the hook will be swung downwardly. The downward swinging movement of the hook causes the keeper 34 to relatively move into the slot 33 into engagement with camming edges 36 of the slot and produce increased forces for effecting closing and opening movements of the drawer by virtue of swinging movements of the handle 28. With the handle 28 in the position shown in FIG. 3, the keeper 34 will be positioned at the innermost end of the slot 33, and in this position, the hook serves to lock the drawer against opening movement. It is to be understood, that with the handle 28 in the position shown in FIG. 4, the handles of the first actuators provide means for effecting the normal opening and closing sliding movements of the drawer.

The operation of the first actuator 26, and the structural details thereof, is specifically described and claimed in copending application, Ser. No. 586,290 filed June 12, 1975.

SECOND MANUAL ACTUATOR MEANS

Unique means are provided by the present invention to correct the inherent disadvantages attending the utilization of conventional sliding drawer cabinets for the mounting of electronic and other sensitive equipment in areas where the cabinets may be subject to environmental vibrations and shock forces which could be transmitted and amplified by reason of the normal clearances utilized for the slide mountings of the drawers, and which could reach sufficient proportions as to damagingly affect the sensitive equipment.

For this purpose, second actuator means 37 are provided for the operation of connected locking elements which will function to produce wedging forces which will act horizontally and vertically between the slide mounting elements of the drawer in such a manner that the normal sliding clearances will be rendered ineffectual to transmit and amplify the environmental vibrations and shock forces with respect to the sliding drawer. More specifically, as shown in FIG. 1, a pair of second actuators 37 are respectively mounted at the opposite ends of the front panel 18 in inwardly spaced relation to the first pair of actuators 26.

Figure 7:
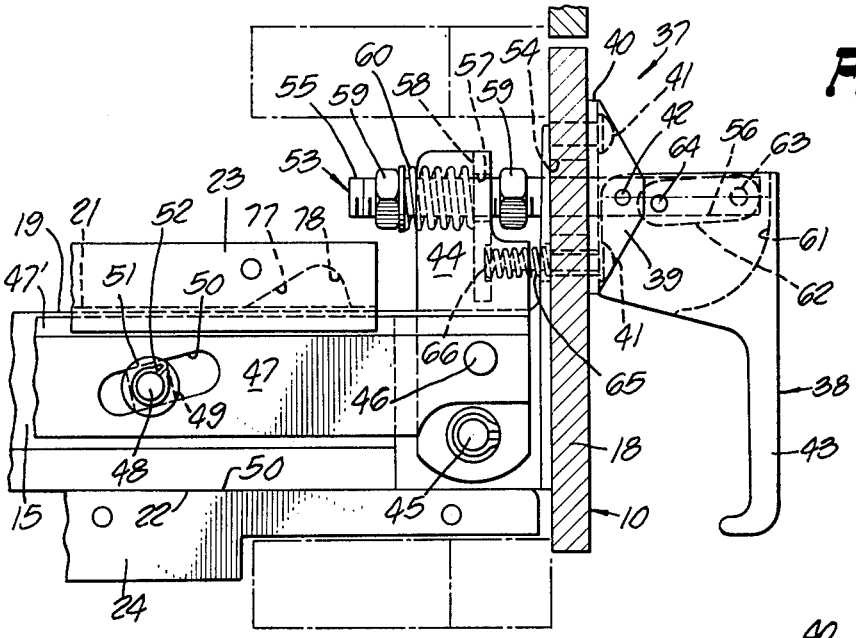
FIG. 7 is an enlarged side elevational sectional view taken substantially on line 7—7 of FIG. 2, and showing details of a second manual actuator means for operating locking elements for frictionally anchoring and retaining the drawer against vibrational movements, the operating handle of the actuator being in its locking position.
Figure 8:
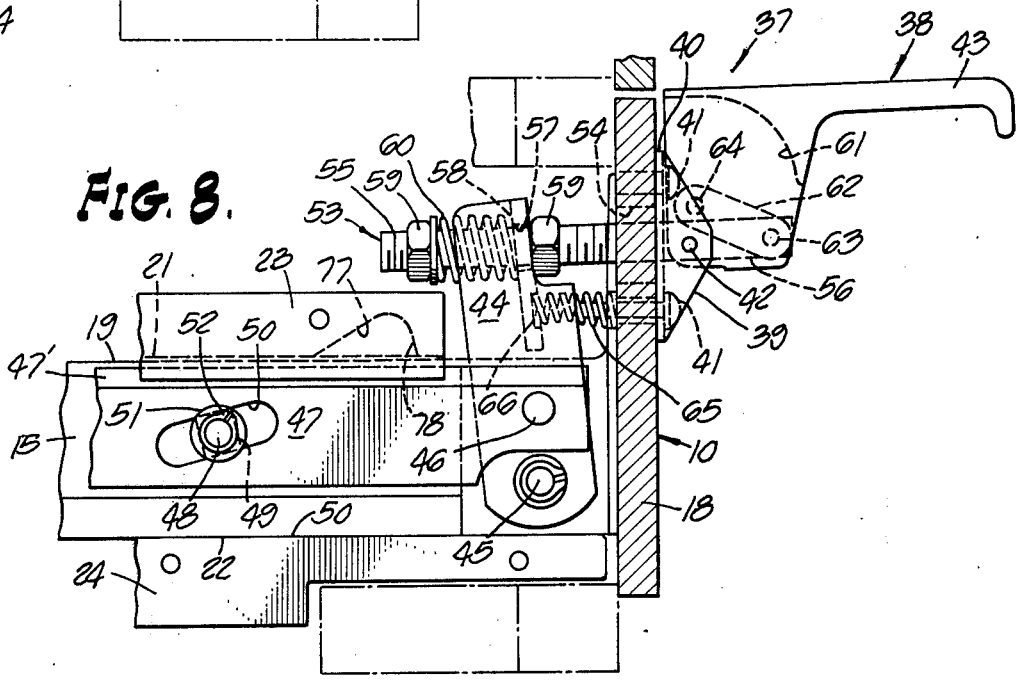
FIG. 8 is a similar view of the mechanism shown in FIG. 7, except that the handle and associated locking elements are shown in unlocked position.

As best shown in FIGS. 7 and 8, each actuator 37 comprises an inverted generally L-shaped handle 38 which is mounted for vertical swinging movement between spaced lugs 39 of a mounting bracket 40 which is secured to the forward face of the panel 18 by means of upper and lower attaching screens 41. The configuration of the handle 38 is such that the pivot axis, as indicated by numeral 42 will be laterally offset with respect to the hand-grip portion 43 in order that the portion 43 will be outwardly spaced from the panel 18, when the handle is in the position shown in FIG. 7.

Adjacent the rear face of the panel 18, an elongated lever 44 is pivotally mounted at its lowermost end to an adjacent portion of the drawer by pivot pin 45 for limited swinging movement and is connected through an adjacent pivotal connection 46 with an end of an elongate locking member in the form of a flat bar which extends longitudinally along an outer face of the drawer slide rail formed by the side wall 15. The locking member 47 is attached for translatory sliding movement throughout its length by means of a plurality of fixed mounting studs 48 which are positioned for relative guided movement by means of a guiding sleeve member 49 within an inclined slot 50. The locking member is retained on the studs by means of a washer 51 and snap ring 52. With the locking member 47 mounted as just described, it will be evident that the inclined slots 50 and the fixed studs 48 provide camming actions in response to longitudinal movements of the locking member 47. For example, when the locking member 47 is moved towards the right, as seen in FIG. 7, the locking member will be raised, and when the locking member is moved towards the left it will be lowered throughout its length. As shown in FIG. 6, the upper edge of the locking member 47 is longitudinally beveled as indicated by the numeral 47' for engaging coaction with a beveled surface 23' extending longitudinally along the upper guide rail 23. As thus arranged, when the locking member 47 is in its lower position, the surfaces 47' and 23' will be disengaged and thus permit normal sliding movement of the drawer. However, when the locking member 47 is raised, the engaged beveled surfaces 47' and 23' coact to provide a wedging action which is effective both in a horizontal direction and a vertical direction between the drawer slide rail and the associated cabinet guide rails. This wedging action thus serves to positively anchor the drawer against any movements within the limits of the normal sliding clearance of its slide mounting, whereby the transmission and amplification of environmental vibrations and shocks due to the normal sliding clearances will be in a great measure prevented.

The second actuator handle 38 is operatively connected with the lever 44 through a linkage which will now be described. An elongated connecting rod 53 is positioned in an opening 54 of the panel 18 for reciprocal movement, this connecting rod having an inner threaded end portion 55 and an outer end portion 56 of rectangular cross-section. The inner threaded end extends through an opening 57 of a right-angled projection 58 at the outermost end of the lever 44. Adjusting nuts 59 are respectively positioned on opposite sides of the projection 58, and a compression spring 60 extends between the innermost of said nuts and the projection. The nuts 59 are so adjustably positioned on the rod that in the locking positions of the locking member 47 and the handle 38, the outermost of the nuts will be in spaced relation to the adjacent face of the projection, and the innermost of the nuts will place the spring 60 under compression so as to resiliently bias the locking member in its locking position and prevent the occurrence of clearance under shock load condition. Upon movement of the actuating handle in a direction to move the locking member to a non-locking position, the compression of the spring 60 will first be relieved prior to the engagement of the outermost nut 59 with the projection.

The pivoted end of the actuator handle 38 is formed with a cavity 61 which permits straddling of the outer end portion 56 of the connecting rod, and a pair of link members 62 positioned respectively on opposite sides of the adjacent end of the connecting rod. These links have corresponding ends connected by a pivot pin 63 to the outer end portion of the connecting rod, while the other ends of these links are respectively connected by short pivot pins 64 to the adjacent side walls of the cavity 61. As will be seen in FIG. 7, the relative relationship of the pivot pins 42, 64 and 63 is such that in the locked position of the handle 38, the pivot pin 64 will be disposed below a center line connecting the pivots 42 and 63. Thus, the action of the spring 60 will resiliently act to maintain the handle 38 in locked position. To release the locking member 47, the handle 38 need only be swung in a counter-clockwise direction to a position such as shown in FIG. 8. This movement carries the pivotal connection 64 through the dead center position in an arcuate path such that the connecting rod will be moved towards the left, as seen in FIG. 8, until the outermost nut 59 positively engages the projection 58 to swing the lever 44 counter-clockwise to release the locking member 47 from its locking position, and move it with translatory movement to an unlocked position as shown in full lines.

It is desirable that the handle 38 should be resiliently retained in its raised unlocked position as shown in FIG. 8. This is accomplished by providing a compression coiled spring 65. One end of this spring is anchored over an inner projecting end of the lowermost attaching screw 41 of the bracket and bears against the innermost surface of the panel 18. The other end of the spring bears against the adjacent surface of the projection 58, and if desired may be seated in a shallow recess 66 formed in the projection surface.

DRAWER LATCHING MECHANISM

As a further feature, the present invention provides a unique latching mechanism for the cabinet mounted sliding drawer, which will be automatically operative at the fully opened position of the drawer to prevent complete removal of the drawer from the cabinet, but which is so located as to be readily accessible for manual release when it is desired to remove the drawer from the cabinet.

As best shown in FIGS. 1 and 5, the latching mechanism includes an elongated lever member 67 which is located adjacent the rear of the drawer and pivotally mounted at its rear end for swinging movement about a pivot 68 fixedly secured to an inner wall surface of the drawer side rail. As thus mounted, the lever is longitudinally movable as a unit with the drawer during its opening and closing movements. Rearwardly of the pivot 68, there is a short tapered projecting end portion having converging edges 70 and 71. On the opposite side of the pivot 68, the lever 67 projects forwardly of the pivot and has its upper edge provided with a notch or indentation 72 containing an abutment shoulder 73 at its rearmost end. At a position generally opposite the notch 72, there is provided a compression spring 74 which is sealed within a well 75 of an adjacent portion of the drawer framing, the upper end of this spring bearing against the lever 67 in a direction acting to normally urge the lever in a clockwise direction about its pivot 68, as seen in FIG. 5. The lever 67 is restrained in a closed position of the drawer from movement by the action of spring 74 by virtue of being positioned below a longitudinal overhanging shoulder 76 of the upper guide rail 23.

Figure 9:
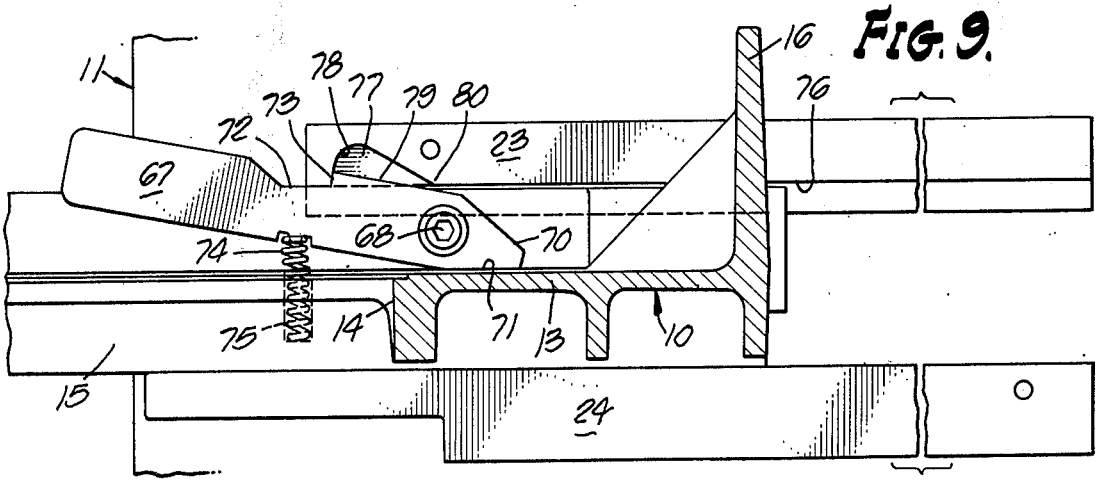
FIG. 9 is a fragmentary view similar to FIG. 5, showing the operative position of the elements of the latching mechanism, when the drawer is in its fully opened position.

Adjacent the outermost end of the guide rail 23, the guide rail is provided with a downwardly opening notch 77 having an abutment shoulder 78. When the drawer is moved to its designed fully opened position, the lever 67 will project beyond the forward end of the guide rail 23, as shown in FIG. 9, and since the projecting end is no longer restrained by the overhanging shoulder 76, the lever will be urged under the action of the spring 74 to an inclined position as limited by the edge 71 and the notches 72 and 77 will coact in a manner to permit the engagement of the abutment shoulder 73 with the abutment shoulder 78 to limit further withdrawing movement of the drawer. Should it be desired to fully remove the drawer, it is merely necessary that the projecting end of the lever be manually depressed against the force of spring 74 to a position in which the engaged abutment shoulders 73 and 78 will become disengaged, whereupon the drawer may be completely withdrawn, when necessary. Although the drawer may be equipped with only one of the latching mechanisms as described above, it will readily appear that these latching mechanisms may be applied to the opposite sides of each drawer, if desired.

In the event that the drawer is not entirely removed, and it is desired to re-close the drawer, the drawer will be moved from open position in a closing direction in the normal manner. The initial closing movement of the drawer will cause an upper edge portion 79 of the lever 67 to bear against a juncture point 80 of the shoulder 76 with the notch 77 in a manner to cam the lever 67 into a position where it extends parallel below the shoulder 76 and is free for longitudinal movement towards the closed position of the drawer.

From the foregoing description and drawings, it will be clearly evident that the delineated objects and features of the invention will be accomplished.

Various modifications may suggest themselves to those skilled in the art without departing from the spirit of our invention, and, hence, we do not wish to be restricted to the specific forms shown or uses mentioned, except to the extent indicated in the appended claims.

We claim:

1. In the combination of a cabinet and a drawer supported for movement between an open extended position projecting from a side of the cabinet and a closed retracted position within the cabinet, the improvement comprising:

a. means supporting the drawer on said cabinet for guided movements between said open and closed positions, and said supporting means comprises side rails carried by said drawer, and guide rails carried by said cabinet respectively operatively associated with each of said drawer side rails; and b. lever actuated means operable in open, closed, and an infinite number of intermediate positions of said drawer of retaining and holding the drawer against vibrational movements said retaining and holding means including means engageable between a drawer side rail and an associated cabinet rail for releasably anchoring said rails against relative movements.

2. The combination according to claim 1, wherein:

said drawer side rails and said cabinet guide rails have sliding engagement; and said anchoring means includes at least one locking member supported for selective movements between locking and non-locking positions with respect to one of said cabinet guide rails and one of said drawer side rails.

3. The combination according to claim 2, in which said locking member in said locking position forms a wedge between the associated cabinet and drawer rails.

4. The combination according to claim 2, in which said locking member in said locking position wedgingly restrains said drawer against vibrational movements both in a vertical direction and horizontal direction.

5. The combination according to claim 2, wherein said locking member comprises an elongated bar mounted on said drawer side rail and extending lengthwise thereof, said bar having a beveled upper edge margin.

6. The combination according to claim 5, including means supporting said bar on a drawer side rail for translatory movements between a lowered non-locking position and a raised locking position.

7. The combination according to claim 6, wherein the bar supporting means comprises a plurality of similarly inclined slots longitudinally spaced along said bar; and a plurality of fixed studs on said associated drawer slide rail respectively positioned in said inclined slots.

8. The combination according to claim 7, in which a sleeve member on each stud positions and guides the stud movement in the slots, said sleeve member having an inner surface contoured to said stud and an outer surface contoured to the engaged portion of the slot.

9. The combination according to claim 6, including a manually operable actuator connected to said bar and being moveable with said drawer for effecting said translatory movements.

10. The combination according to claim 9, in which said actuator includes means for resiliently retaining said bar in its raised locking position.

11. The combination according to claim 9 in which said actuator is carried at the front of the drawer and comprises:

a. a lever pivoted at one end for limited swinging movements and having a connection, adjacent its pivoted end, with the forward end of said bar;

b. a connecting rod having an innermost end connected with the outer end of said pivoted lever;

c. an actuating handle pivotally mounted for swinging movements in opposite directions between predetermined operating limit positions; and d. linkage means interconnecting said actuating handle with said connecting rod, whereby movement of the actuating handle to one of its limit positions actuates said bar to its non-locking position, and movement to its other limit position actuates said bar to its locking position.

12. The combination according to claim 11, wherein the drawer includes a vertically extending front panel; said lever is positioned on the rear side of said panel; said actuating handle is positioned on the front side of said panel; and said connecting rod extends through an opening in said panel.

13. The combination according to claim 11, wherein the innermost end of said connecting rod has a threaded end portion extending on opposite sides of a right angled projection at the outermost end of said pivoted lever; nuts are respectively positioned on opposite sides of said projection; a compression spring on said rod extends between the innermost of said nuts and said projection; said nuts being so adjustably positioned on the rod that in the locking positions of said bar and said actuating handle, the outermost of said nuts will be in spaced relation to the adjacent face of said projection, and the innermost of said nuts will place said spring under compression, and upon movement of said actuating handle in a direction to move said bar to a non-locking position the compression of said spring will first be relieved prior to the engagement of the outermost nut with said projection.

14. The combination according to claim 13, in which said drawer includes a vertically extending front panel, and a spring member stressed between said lever and said panel for urging said lever in a direction opposite that of said compression spring.

15. The combination according to claim 11, in which said linkage means includes elements adapted to assume an over-dead-center latching position when said actuating handle is moved to its said other limit position.

16. The combination according to claim 1, wherein said drawer includes a vertical front panel, and including:

a. first manual actuator means on said panel selectively operable in the final closing movement of the drawer to forceably move the drawer to a fully closed position, and in the initial opening movement of the closed drawer to forceably move the drawer outwardly from the fully closed position; and b. second manual actuator means on said panel for independently operating said retaining and holding means, said first and second actuator means coacting to retain the drawer in closed position.

17. In the combination of a cabinet and drawer supported for movement between an open extended position projecting from a side of the cabinet and a closed retracted position within the cabinet, the improvement comprising:

a. side rails carried by said drawer;

b. guide rails carried by said cabinet respectively operatively associated with each of said drawer side rails; and c. latching means automatically operative between a drawer side rail and an associated cabinet guide rail in the open position of said drawer for preventing removal of the drawer from said cabinet, but being manually releasable to enable drawer removal, when necessary, said latching means comprising:

1. a lever member adjacent the rear end of said drawer side rail pivoted thereon at one end for vertical swinging movement from a normal position extending generally along and parallel to said side rail to an upwardly inclined position in relation to said side rail, the vertical swinging movement of said lever to the inclined position being limited by a tapered side edge at its pivoted end;

2. spring means normally urging said lever towards said inclined position;

3. movement of said lever to said inclined position by said spring means being normally opposed by the associated cabinet guide rail;

4. means at the forward end of said cabinet guide rail operative to release said lever for movement to said inclined position; and 5. abutment means engageable by the lever in said inclined position opposing drawer removal but upon manual movement of said lever from said inclined position being ineffectual, said abutment means comprising cooperable notched portions respectively formed on said lever and said associated guide rail adapted to interfit in said inclined position of the lever, and said notches having edge portions arranged to abut in said inclined position of the lever.

* * * * *